US008044591B2

(12) United States Patent
Takao et al.

(10) Patent No.: US 8,044,591 B2
(45) Date of Patent: Oct. 25, 2011

(54) FLUORESCENT LAMP AND LIGHTING UNIT

(75) Inventors: Yoshifumi Takao, Tokyo (JP); Naoyuki Matsubara, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 399 days.

(21) Appl. No.: 12/352,606

(22) Filed: Jan. 12, 2009

(65) Prior Publication Data

US 2009/0230838 A1 Sep. 17, 2009

(30) Foreign Application Priority Data

Jan. 11, 2008 (JP) ..... 2008-004609

(51) Int. Cl.

| | |
|---|---|
| ***H01J 17/16*** | (2006.01) |
| ***H01J 61/30*** | (2006.01) |
| ***H01J 7/22*** | (2006.01) |
| ***H01J 17/22*** | (2006.01) |
| ***H01J 61/24*** | (2006.01) |
| ***H01J 61/20*** | (2006.01) |

(52) U.S. Cl. ..... 313/634; 313/44; 313/45; 313/485; 313/552; 313/623; 313/639

(58) Field of Classification Search ..... 313/11, 313/42, 44–46, 317, 483–493, 552, 564, 313/565, 573, 623–625, 634, 636–639
See application file for complete search history.

(56) References Cited

U.S. PATENT DOCUMENTS 5,717,277 A * 2/1998 Siminovitch ..... 313/318.02
5,861,714 A * 1/1999 Wei et al. ..... 313/625

FOREIGN PATENT DOCUMENTS

| | | |
|---|---|---|
| JP | 10012191 | 1/1998 |
| JP | 11003682 | 1/1999 |
| JP | 2001243875 | 9/2001 |
| WO | WO 2006000940 A2 * | 1/2006 |

* cited by examiner

*Primary Examiner* — Nimeshkumar Patel
*Assistant Examiner* — Steven Horikoshi
(74) *Attorney, Agent, or Firm* — Kenealy Vaidya LLP

(57) ABSTRACT

A fluorescent lamp can be configured to prevent a decrease in luminescent efficiency when located in a high temperature room. The fluorescent lamp can include a couple of stems each including an emitter electrode located opposite to each other at each end of a tube, a filler gas located in the tube, a damping material and a coolest portion connected to the tube via the stem and the damping material. The coolest portion can be configured with a first material that has a higher thermal conductivity than the conductivity of both the tube and the stems. The damping material can be configured with both the first material and a second material that has a lower conductivity than the conductivity of the first material. A content ratio of first material vs. second material can change along a length of the damping material. Thus, the coolest portion can maintain a favorable temperature and the fluorescent lamp can maintain a favorable luminescent efficiency even when in a sealed casing.

20 Claims, 6 Drawing Sheets

FLUORESCENT LAMP AND LIGHTING UNIT

This application claims the priority benefit under 35 U.S.C. §119 to Japanese Patent Application No. 2008-004609 filed on Jan. 11, 2008, which is hereby incorporated in its entirety by reference.

BACKGROUND

1. Field

The presently disclosed subject matter relates to a fluorescent lamp, and more particularly to a hot cathode fluorescent lamp which, in at least one embodiment, can be used as a light source for a lighting unit such as a back light unit of a liquid crystal display mounted in a casing.

2. Description of the Related Art

Fluorescent lamps are broadly used as a light source in various fields such as a general lighting, consumer products, industrial products, etc. The fluorescent lamps can be generally classified into a cold cathode fluorescent lamp (CCFL) and a hot cathode fluorescent lamp (HCFL) type lamp.

The CCFL is frequently used as a light source for a backlight unit, which is mounted on the back of a liquid crystal display (LCD) in order to facilitate visualization of the LCD while using office automation equipment such as a personal computer, a printer, etc. A reason why the CCFL is frequently used as a light source for the backlight unit is that the CCFL may not generate a large amount of heat and may enjoy low power consumption. The HCFL also comes into use as a light source for the backlight unit in equipment using a large size LCD, because it has characteristics of both a high luminescent efficiency type lamp and high-light intensity lamp as compared with the CCFL.

Typical fluorescent lamps can include: a tube unit coated with a phosphor on an inner surface thereof; a couple of stems, each attached to a respective end of the tube unit so as to seal the tube therebetween, the stems can each include an electrode so that each electrode faces with respect to each other in the tube unit; and a filler gas including a mercury vapor and an inert gas can be enclosed in the tube unit. In this case, the CCFL can emit a discharge optical light without heating the electrodes thereof and the HCFL can emit a discharge optical light by heating the electrodes thereof.

The luminescent efficiency of the fluorescent lamp may be changed by the vapor pressure of mercury in the filler gas that is enclosed in the tube unit. The vapor pressure of mercury may be adjusted so as to become a maximum value of the luminescent efficiency at around 25 degrees centigrade of ambient temperature in which the fluorescent lamp may be used. The vapor pressure may be easily varied with changes in temperature of a coolest point in the tube unit.

Therefore, various arts for properly maintaining the vapor pressure are generally known. For example, Patent Document No. 1 (Japanese Patent No. 3478369) discloses a fluorescent lamp including a structure for providing a coolest portion with an edge portion of an exhaust pipe, and therefore the conventional fluorescent lamp may prevent the coolest portion from experiencing a significant or undesired rise in temperature thereof. Patent Document No. 2 (Japanese Patent Application Laid Open JP2001-243875) discloses a fluorescent lamp that provides cooling holes with an edge portion for mounting the circular fluorescent lamp in order to prevent the coolest portion from experiencing a significant or undesired rise in temperature.

On the other hand, a fluorescent lamp for allowing a charge optical emission at a high ambient temperature is disclosed in Patent Document No. 3 (Japanese Patent Application Laid Open H10-12191). The conventional fluorescent lamp provides a mercury amalgam with a coolest portion that is located at an edge portion thereof. Therefore, the conventional fluorescent lamp may prevent the mercury from over-evaporating under the circumstance of a high ambient temperature.

The above-referenced Patent Documents are listed below, and are hereby incorporated with their English abstracts in their entireties.

1. Patent Document No. 1: Japanese Patent No. 3478369
2. Patent Document No. 2: Japanese Patent Application Laid Open JP2001-243875
3. Patent Document No. 3: Japanese Patent Application Laid Open H10-12191

When the fluorescent lamp is used as a light source for a lighting unit such as a backlight unit, the bulb-typed lighting unit may be sealed within an outer casing or the like, and the fluorescent lamp may be left in a space in which an ambient temperature may easily rise because of heat generated from the lamp or from the control circuit. Therefore, luminescent efficiency of the fluorescent lamp may decrease because vapor pressure of mercury within the lamp becomes higher than its usual pressure.

In this case, in the conventional fluorescent lamps which provide a coolest portion, the coolest portion is integrated with the tube unit or the stem using the same material such as a glass, a ceramic, and the like, and is formed with a low radiating structure especially in the casing. Therefore, the conventional fluorescent lamp may not prevent the coolest portion from experiencing a rise in temperature with confidence under the above-described circumstance in which the ambient temperature thereof easily rises, and the rise in temperature near the coolest portion may cause an increase of the vapor pressure of mercury.

Thus, the conventional fluorescent lamp may experience a negative effect such that the luminescent efficiency may easily decrease, especially under the above-described circumstance. The fluorescent lamp may require that an effective radiator be provided with the coolest portion thereof in order to consistently prevent the coolest portion from experiencing the above-described rise in temperature. However, the fluorescent lamp including the radiator requires a more complex structure for manufacture, a higher relative cost, etc.

With respect to the conventional fluorescent lamp including the mercury amalgam, it may be difficult to quickly evaporate the mercury at the beginning of emission for the fluorescent lamp, and the vapor pressure of mercury may become low. Therefore, the fluorescent lamp may include a negative effect in that the light intensity thereof may become low at the beginning of emission. In addition, because an impurity may become easily attached to a surface of the mercury amalgam, the fluorescent lamp may cause a problem in that the vapor pressure of mercury may venture outside of a predetermined appropriate value.

The disclosed subject matter has been devised to consider the above and other features, problems and characteristics. Thus, embodiments of the disclosed subject matter can include a fluorescent lamp with a simple structure that can prevent the coolest portion from a rise in temperature and can prevent the lamp from experiencing a decrease of luminescent efficiency even under the circumstance in which the ambient temperature may rise. The disclosed subject matter can also include a lighting unit using the fluorescent lamp, which can maintain a favorable light-emission even in a sealed casing.

SUMMARY

The presently disclosed subject matter has been devised in view of the above and other problems and characteristics in the conventional art, and to make certain changes to existing lamp structure. Thus, an aspect of the disclosed subject matter includes providing a lighting unit using a fluorescent lamp that can prevent a decrease of luminescent efficiency thereof even under the tight circumstance in which the ambient temperature may rise, such as in a sealed casing.

According to another aspect of the disclosed subject matter, a fluorescent lamp can include a tube configured in a tubular shape having an inner surface thereof including a phosphor layer, and a couple of stems including an exhaust pipe in a tubular shape and a gateway and an emitter electrode, the couple of stems being located opposite to each other at both ends of the tube and each exhaust pipe thereof extending towards the outside of the tube, each tubular space of the exhaust pipes connected to a tubular space of the tube via each gateway, either exhaust pipe configured in a closed end and the other exhaust pipe configured in an open end, and each emitter electrode thereof facing with respect to each other in the tube.

The fluorescent lamp can also include: a damping material concentrically connected to the open end of the exhaust pipe and configured in a tubular shape having a open end; a coolest portion configured in a tubular shape having both a closed end and an open end, and the open end thereof concentrically connected to the open end of the damping material; a filler gas including a mercury vapor located in the tube sealed in an air proof state.

In the above-described fluorescent lamp, the coolest portion is configured with a first material that has a higher thermal conductivity than of both the tube and the stems, and the damping material is configured with both the first material and a second material that has a lower thermal conductivity than that of the first material and can be connected to the stem, and the content ratio of the first material to the second material is configured to change between the open end towards the coolest portion and the other open end towards the exhaust pipe so as to become high towards the open end and so as to become low towards the other end of the damping material.

In the above-described exemplary fluorescent lamp, both the coolest portion and the damping material can be placed in or at a hole in a wall of the tube from the exhaust pipe by closing the open end of the exhaust pipe. In addition, a ring can be made by connecting the coolest portion of both the coolest portion and damping material to a second damping material that is configured to form the mixture material of the first and the second materials in a direction opposite to the damping material and can be located between the tube and either stem in the same tubular shape as the tube.

According to the above-described exemplary fluorescent lamps, because the coolest portion is composed of the first material having a high thermal conductivity and the radiation performance in the coolest portion can become high, the fluorescent lamps can prevent the coolest portion from experiencing a rise in temperature and therefore the fluorescent lamps can prevent a decrease of luminescent efficiency that may be caused during the emission thereof. In addition, the above-described connections with respect to the both coolest portion and damping material can maintain a stable and favorable state in the long term because the damping material is composed of a mixture material of the first material and the second material, in which the content ratio can be changed.

An aspect of the disclosed subject matter can include a lighting unit including the above-described fluorescent lamp and an outer casing for covering the fluorescent lamp. In this case, the coolest portion can easily contact a part having high thermal conductivity in the outer casing because the coolest portion having a high thermal conductivity is located at an end of the fluorescent lamp. Thus, the lighting unit can emit a favorable light while maintaining a predetermined luminescent efficiency even in a sealed casing by radiating an excess heat of the coolest portion via the outer casing.

BRIEF DESCRIPTION OF THE DRAWINGS

These and other characteristics and features of the disclosed subject matter will become clear from the following description with reference to the accompanying drawings, wherein.

DETAILED DESCRIPTION OF EXEMPLARY EMBODIMENTS

Figure 1:
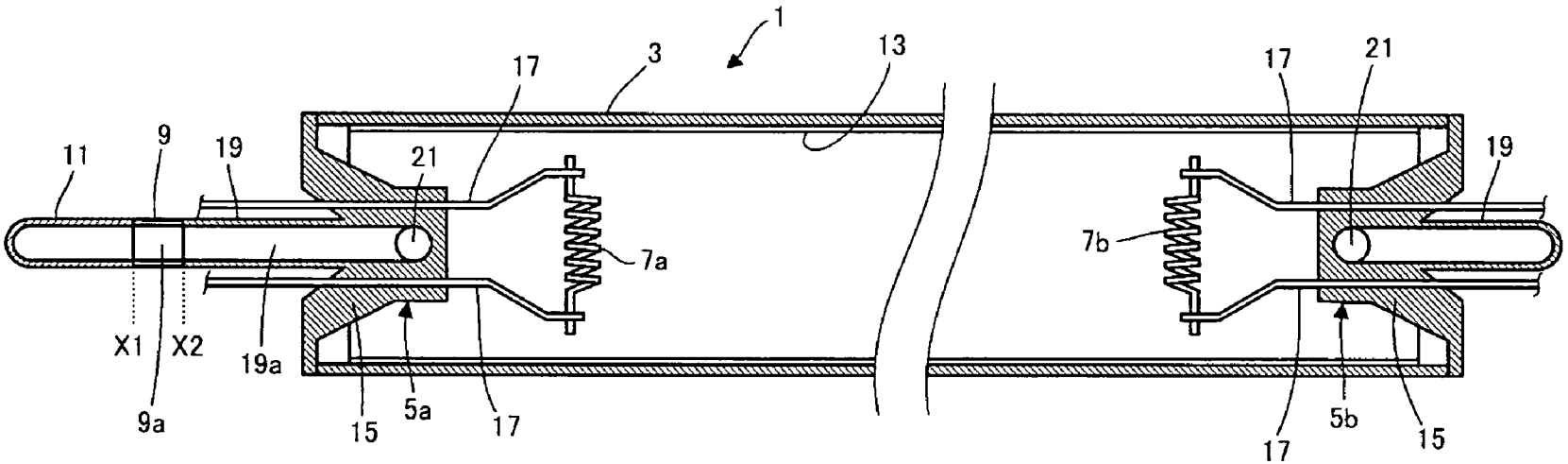
FIG. 1 is a cross-section view showing a first exemplary embodiment of a fluorescent lamp made in accordance with principles of the disclosed subject matter.
Figure 2:
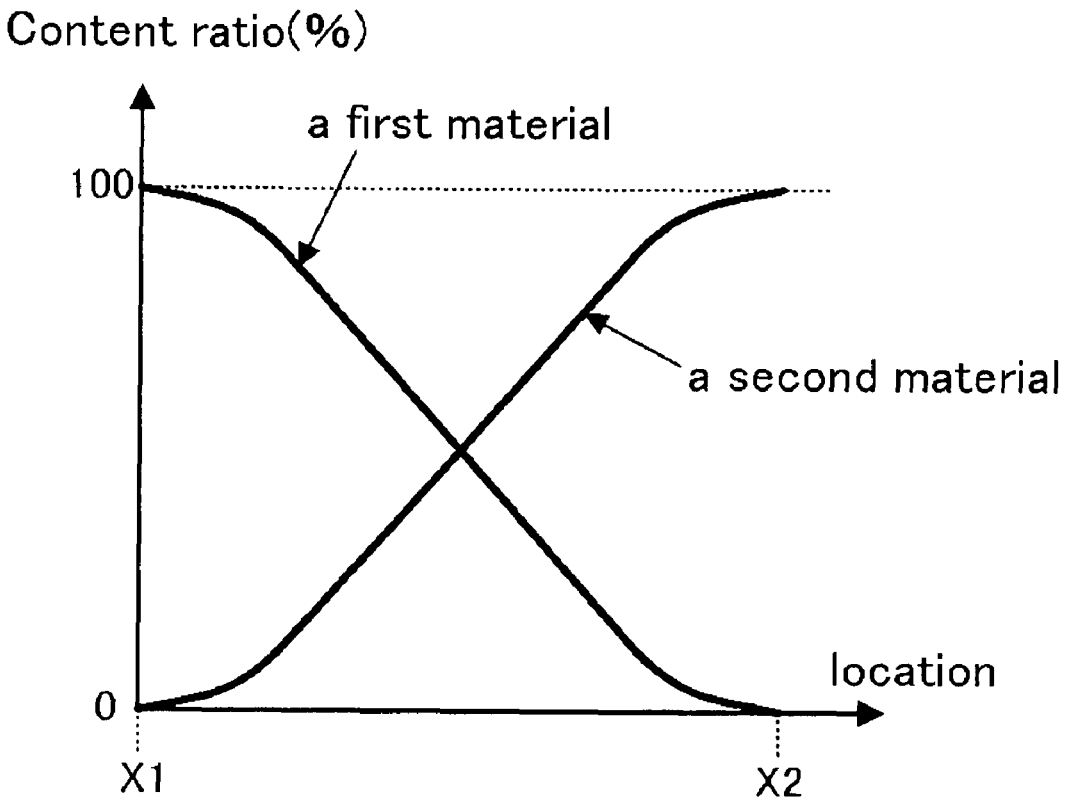
FIG. 2 is a diagram showing a content ratio percentage between a first material and a second material in a damping material that is provided with the first exemplary embodiment fluorescent lamp shown in FIG. 1.

Exemplary embodiments of the disclosed subject matter will now be described in detail with reference to FIG. 1 to FIG. 5. FIG. 1 is a cross-section view showing a first exemplary embodiment of a fluorescent lamp made in accordance with principles of the disclosed subject matter. FIG. 2 is a diagram showing content ratio between a first material and a second material in a damping material that is provided in the first exemplary embodiment fluorescent lamp shown in FIG. 1.

The fluorescent lamp 1 can be composed of a light-emitting tube 3 and a couple of stems 5*a*, 5*b*. The tube 3 can be configured in a cylindrical tubular shape with glass or quartz, a ceramic, etc., and the stems 5*a*, 5*b* can be located opposite to each other at opposite ends of the tube 3. Each of the stems 5*a*, 5*b* can include an emitter electrode 7*a*, 7*b*, respectively, so as to face with respect to each other in the tube 3. One of the stems 5*a*, 5*b*, for instance, the stem 5*a*, can be configured to connected to the coolest portion 11 opposite the emitter electrode 7*a* via a damping material 9.

The tube 3 when configured in the cylindrical tubular shape can include a phosphor layer 13 on an inner surface thereof. The tube 3 is not limited to a straight tubular shape and can be formed as a circle tubular shape, a U-shaped tubular shape, a winding tubular shape such as a W-shape, etc. The cross-section of the tube can also vary depending on a particular application for the lighting device.

Each of the stems 5*a*, 5*b* can include a flare 15 that is composed of glass or quartz, a ceramic, etc. Each of the flares 15 can include a bottom portion that has an outer circumference joined to the tube 3 by an adhesion, a weld, etc. Each of the flares 15 can also be configured to pass through each open end of the tube 3 so as to face towards a tubular space with respect to each other.

Thus, each of the stems 5*a*, 5*b* can be attached to each end of the tube 3 while sealing the tube 3 at each end of the tube 3. A filler gas can be located in the tube 3 and sealed between each of the stems 5*a*, 5*b*. The filler gas can be composed of a mercury vapor and inert gas such as argon gas, etc.

Each of the emitter electrodes 7*a*, 7*b* can be located facing towards the tubular space of the tube 3 and extending from each of the stems 5*a*, 5*b*. The fluorescent lamp 1 in the first exemplary embodiment is a HCFL and therefore each of the stems 5*a*, 5*b* can be composed of a coiled filament that is covered with an emitter material. Each of the stems 5*a*, 5*b* can include lead wires 17 that pass through each flare 15 in both directions towards the tubular space of tube 3 and to the outside of the tube 3.

Each of the emitter electrodes 7*a*, 7*b* can be attached to each of the lead wires 17 between both edge portions of each of the lead wires 17, which extend towards the tubular space of the tube 3. Therefore, each of the emitter electrodes 7*a*, 7*b* can be attached to each of the stems 5*a*, 5*b* via each of the lead wires 17, and can receive power via each of the lead wires 17 that extend to the outside and ultimately to a power supply source.

Each of the stems 5*a*, 5*b* can include an exhaust pipe 19 extending from each of the flares 15 so that each exhaust pipe 19 extends from a center portion of each of the flares 15 and to the outside of the tube 3. A tubular space 19*a* of the exhaust pipe 19 can be connected to the tubular space of the tube 3 via a gateway 21. Thus, the exhaust pipe 19 can be used for exhausting inner air located in the tube 3 and for filling the filler gas in the tube 3 when manufacturing the fluorescent lamp 3.

In the fluorescent lamp 3 of the first exemplary embodiment, the stem 5*b* of the stems 5*a*, 5*b* can be closed at an end by the exhaust pipe 19 using a welding process. On the other hand, an end of the exhaust pipe 19 of the stem 5*a* can be configured to connect to a coolest portion 11 via a damping material 9. The damping material 9 can be configured in a cylindrical tubular shape that includes open ends X1, X2 with a tubular space 9*a* located between both open ends X1, X2.

The coolest portion 11 can be configured in a tubular shape with one closed end like a test tube. Another open end of the coolest portion 11 can be connected to one open end X1 of the damping material 9 as a concentric cylindrical tubular shape, and another open end X2 of the damping material 9 can be connected to the open end of the exhaust pipe 19 of the stem 5*a* as a concentric cylindrical tubular shape.

Thus, a tubular space of the coolest portion 11 can be connected to both the tubular space 9*a* of the damping material 9 and the tubular space 19*a* of the exhaust pipe 19 of the stem 5*a* as a concentric cylindrical tubular shape, and finally can be connected to the tubular space of the tube 3 via the gateway 21 in the flare 5*a* of the stem 15.

The coolest portion 11 can be configured with a first material that has a higher thermal conductivity than these of both the tube 3 and the stems 5*a*, 5*b*. The first material in the fluorescent lamp 1 of the first exemplary embodiment can be a metallic material such that may not be made into an amalgam by the mercury vapor in the filler gas, or can be a metallic material with a high melting point such that may be difficult to be made into an amalgam by the mercury vapor. For example, a metallic material such as a platinum (Pt) material, a manganese (Mn) material, an iron (Fe) material, a cobalt (Co) material, a nickel (Ni) material, a tungsten (W) material and the like can be used as the first material.

However, the first material of the coolest portion 11 can include a metallic material with a low melting point such as a zinc (Zn) material, a tin (Sn) material, a lead (Pb) material and the like by plating the above-described metallic material that has a high melting point on a inner surface thereof. In addition, if a melting point of the first material is higher than the melting point of both the tube 3 and the stems 5*a*, 5*b*, a material other than the above-described metallic materials can also be used as the first material. For instance, a ceramic material having a higher melting point than the stems 5*a*, 5*b* can be used as the first material.

The damping material 9 can be configured with both the first material and a second material that has a lower thermal conductivity than that of the first material and is able to easily connect to the stem 5*a*. For example, the second material can be composed of the same material as the stems 5*a*, 5*b* such as a glass, quartz, a ceramic and the like, and the damping material 9 can be composed of both the first material and the second material, in which the content ratio between first and second materials can be changed between the one open end X1 and the other open end X2 of the damping material 9, as shown in FIG. 2.

In FIG. 2, the x-axis shows a location of the damping material 9 in a direction towards the exhaust pipe 19 in a case that a coordinate origin of x-axis is located at the one open end X1 of the damping material 9. The y-axis shows the content ratio between the first material and the second material with respect to unit volume of the damping material 9.

In this case, the content ratio of the first material to the second material at the open end X1 of the damping material 9 can be 100:0. The content ratio of the first material to the second material at the other open end X2 of the damping material 9 can be 0:100. As the location on x-axis in the damping material 9 approaches from the open end X1 to the other open end X2, the content ratio of the first material to the second material of the damping material 9 can change between the open end X1 and the other open end X2 such that the content ratio of the first material decreases from 100% to 0% and the content ratio of the second material increases from 0% to 100%.

Thus, the content ratio of the first material to the second material of the damping material 9 can change such that the nearer the location with respect to the open end X1 in the damping material 9 is, the higher the content ratio of the first material to the second material is, and the nearer the location with respect to the other open end X2 in the damping material 9 is, the higher the content ratio of the second material to the first material is.

The damping material 9 can be made by sinter-bonding a laminate material having a plurality of circular layers that are intergraded the mixture ratio of the first material and the second material. In this case, when an end circular layer of the one open end X1 is made of the same material and in the same shape as the open end of the coolest portion 11, it is easy to integrate the damping material 9 into the coolest portion 11 as one body.

The other open end X2 of the damping material 9 can be connected to the open end of the exhaust pipe 19 using a welding process, etc. The connection can also be welded via a flit glass in order to ease an alignment between the other open end X2 and the open end of the exhaust pipe 19. Thus, the coolest portion 11 can be connected to the stem via the damping material 9 in an air proof state.

The second material of the damping material 9 is not necessarily the same material as the stems 5*a*, 5*b* but can be composed of different materials as compared to the material of the stems 5*a*, 5*b*. For instance, when the stems 5*a*, 5*b* are composed of a glass, a ceramic can be used as the second material. When the second material is different from that of the stems 5*a*, 5*b*, it may be favorable to compose the second material of a material having similar physical characteristics such as a thermal expansion coefficient, a thermal conductivity, a melting point and the like as compared to the stems 5*a*, 5*b*.

In order to facilitate the gathering of mercury vapor that is encapsulated in the tube 3 into the coolest portion 11, the inner diameter of the exhaust pipe 19, damping material 9, and the coolest portion 11 can be 1.8 mm, and the length thereof can be less than 20 mm from the end extending from the stem 5*a* of the tube 3 to the closed end of the coolest portion 11.

In the fluorescent lamp 1 of the first exemplary embodiment, because the coolest portion 11 that is composed of the first material having a higher thermal conductivity than that of the tube 3 and the stems 5*a*, 5*b* is connected to the stem 5*a* via the damping material 9, the connection between the coolest material 11 and the stem 5 can maintain a stable and favorable state in the long term so as not to cause a deterioration, such as a crack, therein.

In addition, because the coolest portion 11 is composed of the first material having a high thermal conductivity, a radiation performance in the coolest portion 11 can be higher as compared with other parts of the fluorescent lamp 1. Thus, even when the fluorescent lamp 1 may be left in a space having a high ambient temperature such as when that the fluorescent lamp 1 is used as a light source for the backlight unit of an LCD or for the bulb-typed lighting unit sealed in the outer container, the coolest portion 11 can prevent the above described fluorescent lamp 1 from experiencing an excess rise in temperature during the light-emission thereof.

Moreover, because the configuration of the fluorescent lamp 1 can prevent the tube 3 from experiencing an over pressure of the mercury vapor that is caused by excessively evaporating the mercury clumped in the coolest portion 11 during the light-emission thereof, the fluorescent lamp 1 can prevent a decrease of the luminescent efficiency that may be caused during the light-emission thereof.

The fluorescent lamp 1 can be configured to maintain the temperature of the coolest portion 11 at room temperature (ambient temperature) so that the luminescent efficiency of the lamp becomes optimally-matched. When the temperature of the coolest portion 11 becomes lower than room temperature, the luminescent efficiency of the fluorescent lamp 1 may decrease due to a lack of pressure of mercury vapor. Thus, in the fluorescent lamp 1 of the above-described embodiment, the temperature of the coolest portion 11 can be maintained at around 25 degree centigrade of normal temperature. The same is true at least in part with respect to the following exemplary embodiments described later.

Figure 3:
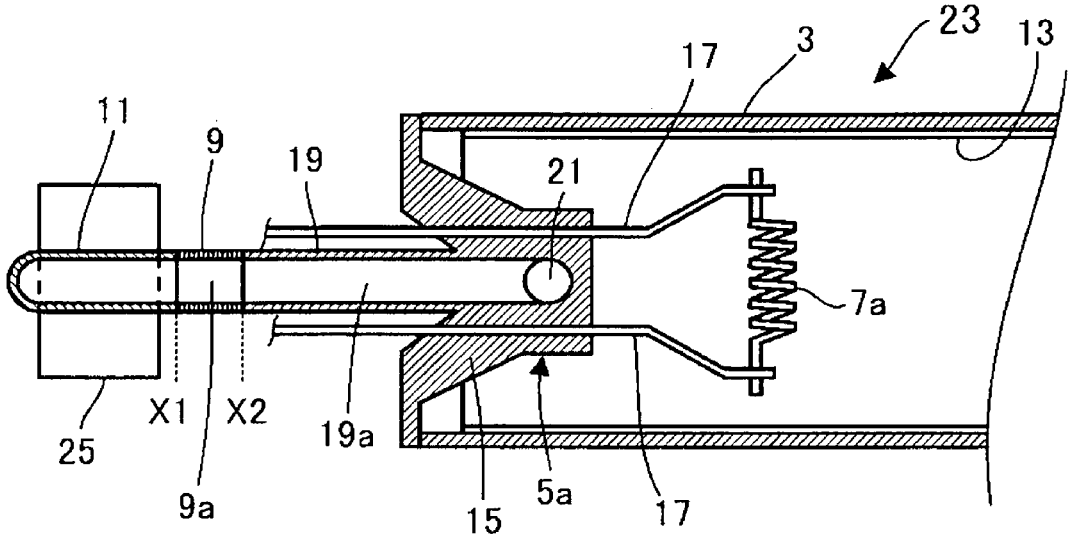
FIG. 3 is a partial cross-section view showing a second exemplary embodiment of a fluorescent lamp made in accordance with principles of the disclosed subject matter.
Figure 4:
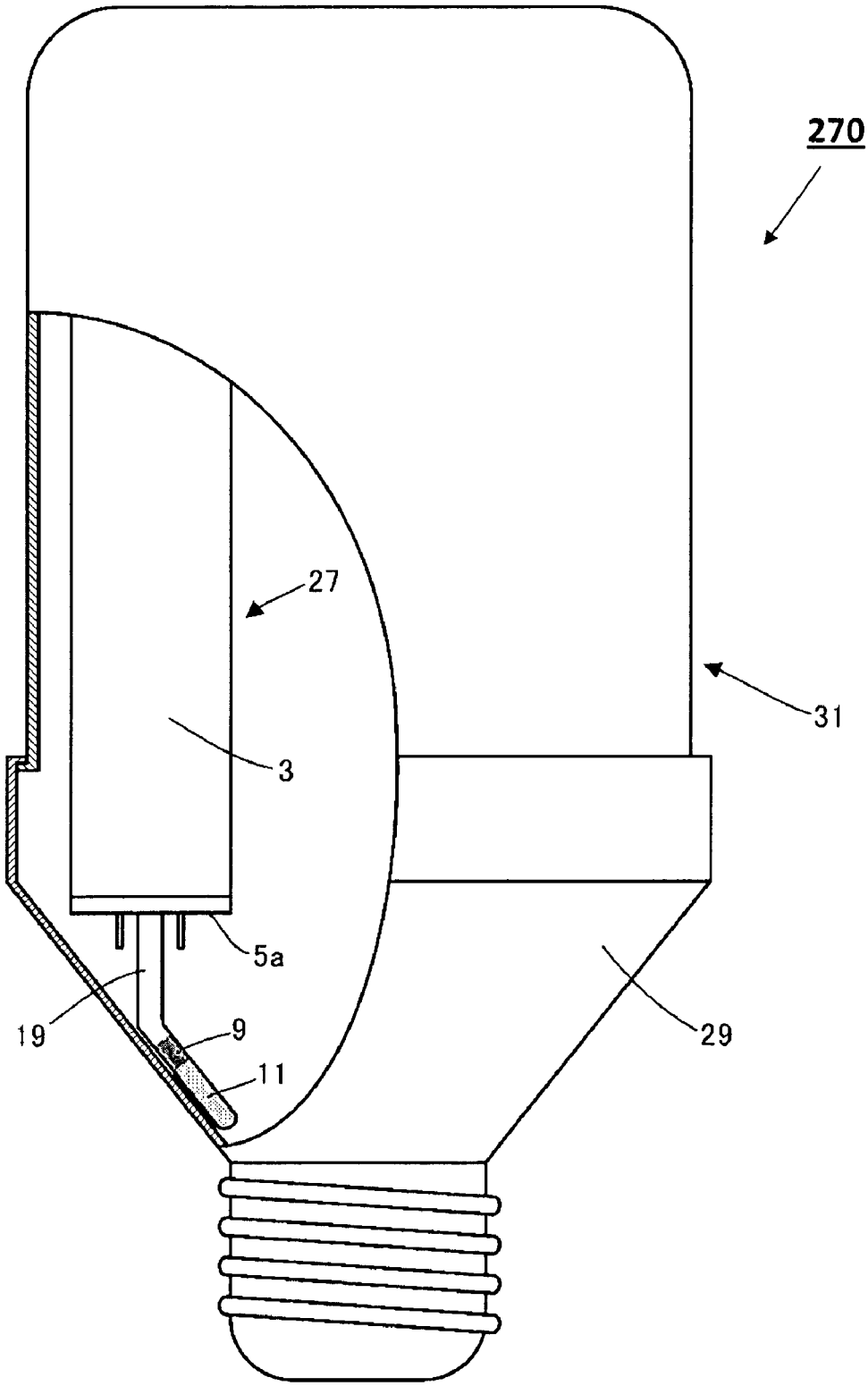
FIG. 4 is a partial closeup cross-section view depicting a third exemplary embodiment of a fluorescent lamp made in accordance with principles of the disclosed subject matter.

Second and third exemplary embodiments of the disclosed subject matter will now be described in detail with reference to FIGS. 3 and 4. FIGS. 3 and 4 are respectively partial closeup cross-section views showing second and third exemplary embodiments of fluorescent lamps made in accordance with principles of the disclosed subject matter. In FIGS. 3 and 4, the same or corresponding elements of the fluorescent lamp 1 in the first exemplary embodiment use the same reference marks as reference marks used in the fluorescent lamp 1 described above, and their description and operation are abridged in the following description.

When a fluorescent lamp may be left in a high ambient temperature, possibly due to heat generated within a sealed casing, the ambient temperature around the coolest portion 11 may also become high. In this case, the coolest portion 11 of the fluorescent lamp 23 in the second exemplary embodiment can be cooled down by a radiator 25. The fluorescent lamp 23 shown in FIG. 3 can be an exemplary embodiment including a radiator 25 fitted in the fluorescent lamp 1 of the first exemplary embodiment.

The radiator 25 may be easily attached to the coolest portion 11 because the coolest portion 11 in the fluorescent lamp 23 can be located at an end of the lamp 23 and can be thinner than the tube 3. The fluorescent lamp 23 can include a radiator 25 such as a peltiert device, a heat sink, a heat pipe, etc. The radiator 25 can be attached to the coolest portion 11 in order to maintain the temperature of the coolest portion at the predetermined normal temperature. Other than the radiator 25, the fluorescent lamp 23 may be configured the same as the fluorescent lamp 1 of the first embodiment.

When the light fluorescent lamp can be or is designed to be placed in an outer casing and/or can be connected to an outer electrode that is composed of a metallic material for receiving a power supply, the temperature of the coolest portion 11 can be radiated to the outside by contacting a part of high thermal conductivity thereto. The fluorescent lamp 270 in the third exemplary embodiment shown in FIG. 4 can be an exemplary embodiment that is configured for use with an outer casing.

In particular, the fluorescent lamp 270 includes a lighting device 27 placed in an outer casing 31, which in this example is bulb-typed with a screw base 29 for receiving power from a power supply. The lighting device 27 can be a U-shaped lamp, a winding type lamp such as a W-shaped lamp, combinations, etc. In the third exemplary embodiment of the fluorescent lamp 270, the coolest portion 11 that is connected to the exhaust pipe 19 of the stem 5*a* via the damping material 9 can be attached to an inner surface of the screw base 29. Thus, the temperature of the coolest portion 11 of the fluorescent lamp 27 can be radiated to the outside using the screw base 29.

In this case, because the coolest portion 11 is attached to the screw base 29 along the slanted inner surface thereof, the exhaust pipe 19 can be formed in a slanted manner so as to fit the slanted inner surface. Other structures other than those described above with respect to the fluorescent lamp 270 may be same as the fluorescent lamp 1 of the first embodiment.

According to the fluorescent lamp 23 in the second exemplary embodiment and the fluorescent lamp 270 in the third embodiment, the rise in temperature of the coolest portion 11 can be avoided with confidence. Specifically, the fluorescent lamp 23 including the radiator 25 can easily maintain the temperature of the coolest portion 11 in a stable state, and therefore the fluorescent lamp 23 can maintain the temperature at a predetermined normal temperature of, for example, 25 degree centigrade with ease.

In the above-described first to third exemplary embodiments, both stems 5*a* and 5*b* include or are attached to respective exhaust pipes 19. However, either one of the exhaust pipes 19 can be eliminated. In addition, the coolest portion 11 may be configured to be connected to a bottom surface of one of the flares 15 of the stems 5*a*, 5*b* via the damping material 9 (removing the need for an exhaust pipe 19).

Moreover, the fluorescent lamp is not necessarily provided with one single coolest portion but can also be provided with a plurality of coolest portions. For example, the fluorescent lamp can include not only the coolest portion 11 connected to the stem 5*a* but also a coolest portion 11 connected to stem 5*b* via exhaust pipe 19 or via damping material 9.

Figure 5:
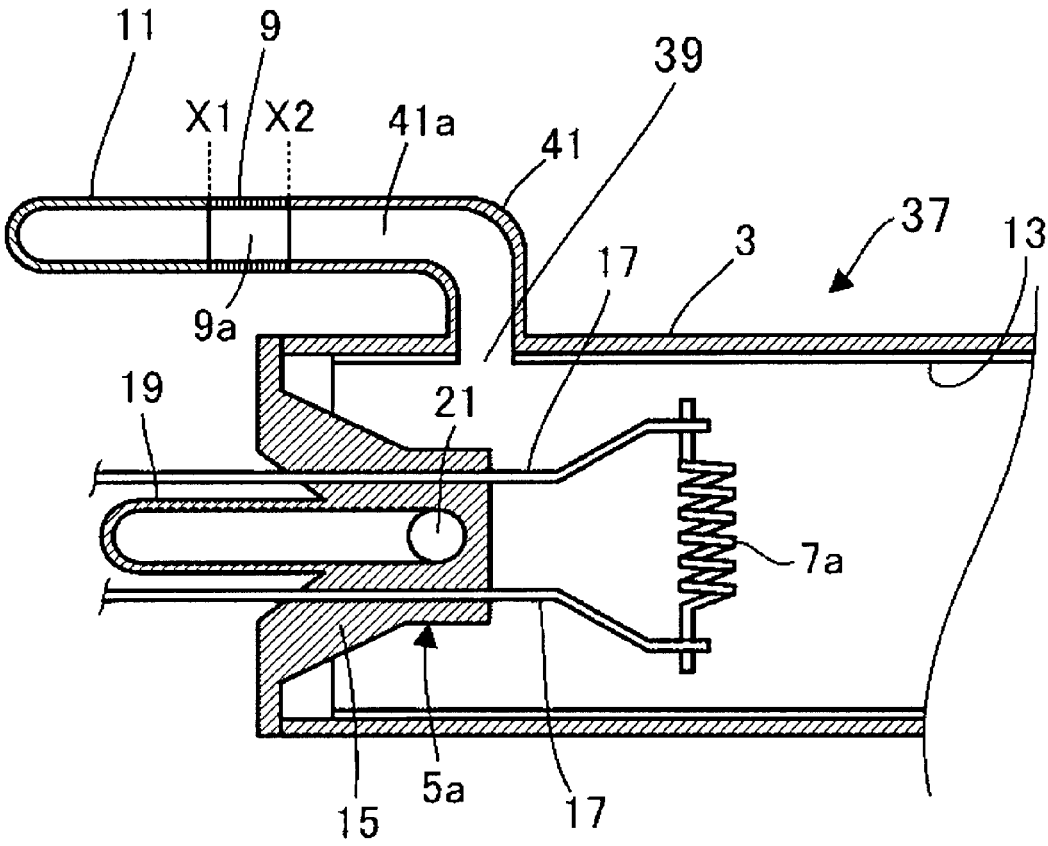
FIG. 5 is a partial cross-section view depicting a fourth exemplary embodiment of a fluorescent lamp made in accordance with principles of the disclosed subject matter.

A fourth exemplary embodiment of the disclosed subject matter will now be described in detail with reference to FIG. 5. FIG. 5 is a partial closeup cross-section view showing a fourth exemplary embodiment of a fluorescent lamp made in accordance with principles of the disclosed subject matter. In FIG. 5, the same or corresponding elements as compared to fluorescent lamp 1 of the first exemplary embodiment use the same reference marks, and their description and operation are abridged in the following description.

In the fluorescent lamp 37 of the fourth exemplary embodiment, the tube 3 can include a hole 39 in a wall thereof, and the hole can be connected to a bypass 41 that is integrated with the tube 3. The hole 39 can be located in any portion of the wall of the tube 3, and possibly extending out of vertical circular lines on the tube 3 surrounding each emitter electrode 7*a*, 7*b* of the stems 5*a*, 5*b*. The bypass 41 can turn and extend from the hole 39 of the tube 3 towards the end opposite the emitter electrode 5*a* of the tube 3. The bypass 41 can include both an open end opposite the hole 39 and a tubular space 41*a* between the open end and the hole 39.

The open end of the bypass 41 can concentrically be connected to a coolest portion 11 via damping material 9. The various shape and construction material of the damping material 9 and the coolest portion 11 can be the same as those described above with respect to the first to third exemplary embodiments. In this case, the other open end X2 that is composed of the second material of the damping material 9 can be connected to the open end of the bypass 41 using a welding process or by welding via flit glass. The one open end X1 that is composed of the first material can be integrated with the coolest portion 11 and the damping material 9 can also be integrated with the coolest portion 11 as one body.

Thus, while the coolest portion 11 can be connected to tube 3 via both the damping material 9 and the bypass 41, the tubular space of the coolest portion 11 can be connected to the tubular space of the tube 3 via the tubular space of the damping material 9, the bypass 41, and the hole 39. The coolest portion 11 can be located beyond the end of the tube 3 along a direction of the tubular space of the tube 3, and can be connected to the hole 39 of the tube 3 via the damping material 9.

The end of the exhaust pipe 19 of the stem 5*a* can be closed by a heating process in the fourth exemplary embodiment. Structures other than those described above with respect to the fluorescent lamp 37 may be the same as in the fluorescent lamp 1 of the first embodiment.

A more detailed description of the fourth exemplary embodiment will now be given. The bypass 41 can be integrated with the other open end X2 of the damping material 9, and after fitting the open end of the bypass 41 in the hole 39 of the tube 3, the bypass 41 can be connected to the tube 3 using a welding process or by a welding via the flit glass. However, the other open end X2 of the damping material 9 can also be connected directly to the tube 3 without the bypass 41.

When the construction material of the tube 3 and the stems 5*a*, 5*b* is different, the second material of the damping material 9 may be of a material that is easily connected to the tube 3, for example, the same material as tube 3. Alternatively, the damping material 9 may be composed of a material having similar physical characteristics such as a thermal expansion coefficient, a thermal conductivity, a melting point and the like as compared to the tube 3.

In addition, the hole 39 of the tube 3 need not necessarily be located in a wall of the tube 3 that extends out of vertical circular lines on the tube surrounding each emitter electrode 7*a*, 7*b* of the stems 5*a*, 5*b* but can be located on a wall of the tube 3 located between the emitter electrode 7*a* and the emitter electrode 7*b*. Both the damping material 9 and the coolest portion 11 can extend in a direction opposite to the tubular space of the tube 3 from the hole 39 of the tube 3 and can also extend along the tubular space of the tube 3 in a direction opposite to the stem 5*a*.

However, so that the damping material 9 and the coolest portion 11 may not shade light emitted by a charge generated between the emitter electrodes 7*a* and 7*b*, the hole 39 of the tube 3 and the damping material 9 and the coolest portion 11 can be located out of the range located between the emitter electrodes 7*a* and 7*b*.

In the fluorescent lamp 37 of the fourth exemplary embodiment described above, because the coolest portion 11 can be connected to the hole 39 of the tube 3 via the damping material 9, the connection between the coolest portion 11 and the tube 3 can maintain a stable and favorable state in the long term so as not to cause a deterioration, such as a crack, therein.

In addition, because the coolest portion 11 is composed of the first material having a high thermal conductivity, the fluorescent lamp 37 can prevent the coolest portion 11 from experiencing an excessive rise in temperature. Because the fluorescent lamp 37 can also prevent the tube 3 from experiencing an over pressure of the mercury vapor caused by excessively evaporating the mercury clumped in the coolest portion 11 during the light-emission thereof, the fluorescent lamp 37 can also prevent a decrease in the luminescent efficiency that may be caused during the light-emission thereof.

Furthermore, in the fourth exemplary embodiment, the coolest portion 11 of the fluorescent lamp 37 like in the second exemplary embodiment can be cooled down by providing a radiator such as a heat sink, etc., therewith. Similarly, as described in the third exemplary embodiment, the thermal conductivity from the coolest portion 11 to the outside can be improved by contacting the coolest portion 11 to a part of high thermal conductivity in the outer casing and the like when the lamp is configured to include such a casing. The fluorescent lamp 37 does not necessarily include a single coolest portion but can also include a plurality of coolest portions. For example, the fluorescent lamp 37 can include two coolest portions 11 that are connected to separate holes located at both edge portions of the tube 3 via separate damping materials 9.

Figure 6:
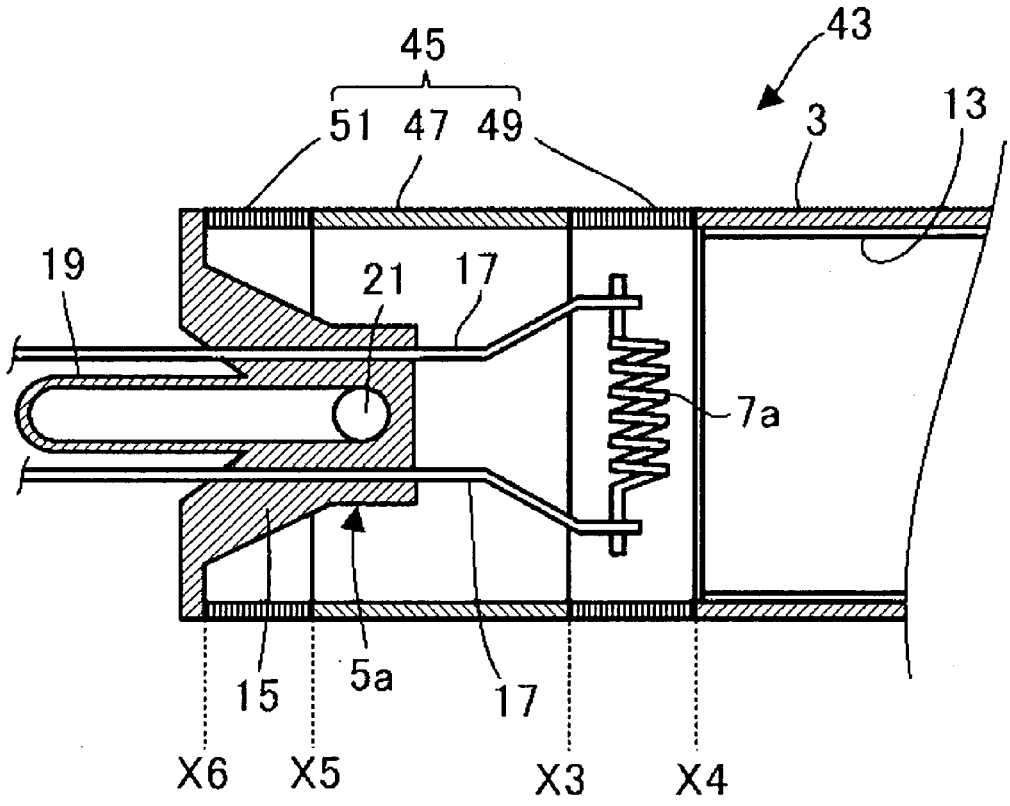
FIG. 6 is a partial cross-section view showing a fifth exemplary embodiment of a fluorescent lamp made in accordance with principles of the disclosed subject matter.

A fifth exemplary embodiment of the disclosed subject matter will now be described in detail with reference to FIG. 6. FIG. 6 is a partial closeup cross-section view showing a fifth exemplary embodiment of a fluorescent lamp made in accordance with principles of the disclosed subject matter. In FIG. 6, the same or corresponding elements use the same reference marks as used in the fluorescent lamp 1 of the first exemplary embodiment described above, and their description and operation are abridged in the following description.

In the florescent lamp 43 of the fifth exemplary embodiment, an open end of the tube 3, for instance, the open end of the tube 3 towards the stem 5*a* can concentrically be connected to a ring 45 having an inner and outer diameter similar to that of the tube 3. The stem 5*a* can be attached to the open end of the tube 3 via the ring 45, and the florescent lamp 43 can be sealed in an air proof state between the stem 5*a* and the tube 3 via the ring 45.

The ring 45 can include a first damping material 49, a coolest portion 47, and a second damping material 51 that are concentrically integrated as one body. The coolest portion 47 can be located between the first damping material 49 and the second damping material 51, and an open end of the ring 45 adjacent the first damping material 49 of the ring 45 can be connected to the open end of the tube 3. Another open end of the ring 45 adjacent the second damping material 51 can be attached to the bottom surface of the flare 15 in the stem 5*a* while sealing the stem 5 to the tube 3.

The coolest portion 47 in the ring 45 can be configured with the first material described in the first exemplary embodiment. The first damping material 49 in the ring 45 can be configured with both the same first material as the coolest portion 47 and a second material that can be easily connected to the tube 3. The content ration of the first material to the second material in the first damping material 49 can increase in a direction towards the coolest portion 47.

The second damping material 51 in the ring 45 can be configured with the same first material as the coolest portion 47 and/or the second material and can be easily connected to the stem 5*a*. The content ratio of the first material to the second material in the second damping material 51 can increase in a direction towards the coolest portion 47.

In the first damping material 49, the content ratio of the first material to the second material can be 100:0 at an open end X3 of the first damping material 49 located adjacent the coolest portion 47 and can be 0:100 at another open end X4 of the first damping material 49 located adjacent the tube 3. The content ratio of the first material to the second material can change in the tubular space of the first damping material 49 as a location changes from the open end X3 to the other open end X4. Specifically, the content ratio of the first material decreases from 100% to 0% and the content ratio of the second material increases from 0% to 100%.

Similarly, in the second damping material 51, the content ratio of the first material to the second material can be 100:0 at an open end X5 of the second damping material 51 located adjacent the coolest portion 47 and can be 0:100 at another open end X6 of the second damping material 51 located adjacent the flare 15 of the stem 5*a*. The content ratio of the first material to the second material can change in a direction from the open end X5 to the other open end X6 such that the content ratio of the first material decreases from 100% to 0% and the content ratio of the second material increases from 0% to 100%.

The damping materials 49, 51 can be made by sinter-bonding a laminate material having a plurality of circular layers that are integrally formed with a mixture ratio of the first material and the second material similar to the damping material 9. In this case, the ring 45 that is integrated with both the coolest portion 47 and the damping materials 49, 51 as one body can be easily made by forming both the open end X3 of the first damping material 49 and the open end X5 of the second damping material 51 with the first material and in the same shape as the coolest portion 47.

The other open end X4 of the first damping material 49 in the ring 45 can be connected to the open end of the tube 3 using a welding process or by welding via flit glass or other attachment process. The other open end X6 of the second damping material 51 can be connected to the bottom portion of the flare 15 of the stem 5*a* using a welding process or by welding via the flit glass, etc. Therefore, the stem 5*a* can be attached to the open end of the tube 3 via the ring 45.

In the fluorescent lamp 43 of the fifth exemplary embodiment, the end of the exhaust pipe 19 of the stem 5*a* can be closed by a heating process. The coolest portion 47 in the ring 45 can be located out of vertical circular lines on the tube and/or the ring surrounding each emitter electrode of the stems. Structures other than those described above with respect to the fluorescent lamp 43 may be same as those disclosed with respect to the fluorescent lamp 1 of the first embodiment.

A more detailed description will now be given with respect to the fifth exemplary embodiment. When each construction material of the tube 3 and the stems 5*a*, 5*b* is different, the second material of the first damping material 49 and the second material of the second damping material 51 can be different, respectively. The second material of the first damping material 49 may include a material that can be easily connected to the tube 3, for example, the same material as the tube 3, or of a material that has similar physical characteristics such as a thermal expansion coefficient, a thermal conductivity, a melting point and the like with respect to the tube 3.

The second material of the second damping material 51 may include a material that can be easily connected to the stem 5*a*, for example, the same material as the stem 5*a*, or can be a material having similar physical characteristics such as a thermal expansion coefficient, a thermal conductivity, a melting point and the like with respect to the stem 5*a*.

In the fluorescent lamp 43 of the fifth exemplary embodiment described above, because the coolest portion 47 can be connected to the tube 3 via the first damping material 49 and can be connected to the stem 5*a* via the second damping material 51, the connections between the coolest portion 47 and both the tube 3 and the stems 5*a* can maintain a stable and favorable state in the long term so as not to cause a deterioration, such as a crack, therein.

In addition, because the coolest portion 47 can be composed of the first material having a high thermal conductivity, the fluorescent lamp 43 can prevent the coolest portion 47 from experiencing an excess rise of temperature. Because the fluorescent lamp 43 can also prevent the tube 3 from experiencing an over pressure of the mercury vapor that is caused by excessively evaporating the mercury clumped in the coolest portion 47 during the light-emission thereof, the fluorescent lamp 43 can also prevent a decrease of the luminescent efficiency that may be caused during light-emission.

Furthermore, in the fifth exemplary embodiment, the coolest portion 47 of the fluorescent lamp 43, similar to the second exemplary embodiment, can be cooled down by providing a radiator such as a heat sink therewith. Similarly, as described in the third exemplary embodiment, the thermal conductivity from the coolest portion 47 to the outside can be improved by contacting the coolest portion 47 to a part having high thermal conductivity, such as in the outer casing and the like. The fluorescent lamp 43 does not necessarily include the single ring 45 including the coolest portion 47 and attached with the end portion of the tube 3, but can also include two rings 45 each located at a respective end portion of the tube 3.

As described above, the disclosed subject matter can provide a HCFL having both a high luminescent efficiency and high-light intensity that may not substantially vary with changes in temperature and can be used as a light source for a lighting unit such as a back light unit of a liquid crystal display mounted in a casing. The HCFL can conform to various requirements for a stable high luminescent efficiency and high-light intensity by using the coolest portion having a high thermal conductivity. Furthermore, because the HCFL has a simple structure, the disclosed subject matter can provide, among the other things, a HCFL having high reliability and manufacturability.

In the above-described exemplary embodiments, a HCFL using the coolest portion and the damping material that is configured with a mixture material of a first material and second material is described. However, the disclosed subject matter is not limited to the above-described embodiments of a HCFL, and can be used in other types of fluorescent lamps such a CCFL and the like without departing from the spirit and scope of the presently disclosed subject matter. There could also be more than two materials that constitute each of the damping materials, and the physical configuration can be changed to meet practically any application for a lighting device or lamp.

While there has been described what are at present considered to be exemplary embodiments of the invention, it will be understood that various modifications may be made thereto, and it is intended that the appended claims cover such modifications as fall within the true spirit and scope of the invention. All conventional art references described above are herein incorporated in their entirety by reference.

What is claimed is:

1. A fluorescent lamp comprising:

a tube configured in a tubular shape having a first end, a second end, and an inner surface, the inner surface of the tube including a phosphor layer, and the tube defining a tubular space therein;

a first stem and a second stem each including a tubular shaped exhaust pipe, a gateway, and an emitter electrode, the first stem and second stem being located opposite to each other and at the first end and second end, respectively, of the tube, and each exhaust pipe extending outside of the tube and defining a tubular space therein, the tubular space of each of the exhaust pipes being connected to the tubular space of the tube via a respective gateway, and the emitter electrode of the first stem facing and opposed to the emitter electrode of the second stem in the tube;

a damping material connected to an open end of the exhaust pipe of the first stem, the damping material configured in a tubular shape and having a first open end and a second open end;

a coolest portion configured in a tubular shape having both a closed end and an open end, and the open end of the coolest portion connected to the first open end of the damping material;

a filler gas including a mercury vapor located in and sealed in an air proof state within the tube, wherein the coolest portion includes a first material that has a higher thermal conductivity than both a thermal conductivity of the tube and a thermal conductivity of the first stem, and the damping material includes both the first material and a second material that has a lower thermal conductivity than the thermal conductivity of the first material, the damping material being connected to the first stem via the exhaust pipe of the first stem, and the content ratio of the first material with respect to the second material of the damping material changes along a distance between the first open end of the damping material located adjacent the coolest portion and the second open end of the damping material located adjacent the exhaust pipe such that the content ratio becomes relatively higher towards the first open end and becomes relatively lower towards the second open end of the damping material.

2. The fluorescent lamp according to claim 1, wherein the damping material is integrated into the coolest portion as one body.

3. The fluorescent lamp according to claim 1, wherein the first material is a metallic material and the second material is a glass.

4. The fluorescent lamp according to claim 2, wherein the first material is a metallic material and the second material is a glass.

5. The fluorescent lamp according to claim 1, further comprising:

a radiator located adjacent the exhaust pipe of the first stem.

6. A fluorescent lamp comprising:

a tube configured as a tubular shaped wall and including an inner surface defining a tubular space, a first end, a second end, a hole that passes through the wall, and a phosphor layer located adjacent the inner surface of the tubular shaped wall;

a first stem and a second stem each including a tubular shaped exhaust pipe with a closed end, a gateway, and an emitter electrode, the first stem located at the first end of the tube and the second stem located at the second end of the tube and opposed to the first stem, the exhaust pipe of each of the first stem the second stem extending outside of the tube and each exhaust pipe defining a tubular space therein, and each tubular space of each of the exhaust pipes is connected to the tubular space of the tube via each gateway, respectively, and the emitter electrode of the first stem is opposed to and faces the emitter electrode of the second stem in the tube;

a bypass connected to the hole of the tube, the bypass configured in a tubular shape having a first open end and a second open end;

a damping material formed in a tubular shape and including a first open end and a second open end, the second open end of the damping material connected to the second open end of the bypass;

a coolest portion configured in a tubular shape having a closed end and an open end, and the open end of the coolest portion connected to the first open end of the damping material; and a filler gas including a mercury vapor located in the tube and sealed in an air proof state, wherein the coolest portion includes a first material that has a higher thermal conductivity than both a thermal conductivity of the tube and a thermal conductivity of the first stem, and the damping material includes both the first material and a second material that has a lower thermal conductivity than the thermal conductivity of the first material, and a content ratio of the first material to the second material in the damping material changes along a distance between the first open end of the damping material and the second open end of the damping material such that the content ratio becomes higher towards the first open end of the damping material and becomes relatively lower towards the second open end of the damping material.

7. The fluorescent lamp according to claim 6, wherein the hole of the tube is located in the wall of the tube and extends outside of vertical circular lines on the tube surrounding the emitter electrode of the first stem, and the coolest portion is located in a direction opposed to the emitter electrode of the first stem.

8. The fluorescent lamp according to claim 7, wherein the damping material is integrated into the coolest portion as one body.

9. The fluorescent lamp according to claim 8, wherein the first material is a metallic material and the second material is a glass.

10. The fluorescent lamp according to claim 7, wherein the first material is a metallic material and the second material is a glass.

11. The fluorescent lamp according to claim 6, wherein the damping material is integrated into the coolest portion as one body.

12. The fluorescent lamp according to claim 11, wherein the first material is a metallic material and the second material is a glass.

13. The fluorescent lamp according to claim 6, wherein the first material is a metallic material and the second material is a glass.

14. A fluorescent lamp comprising:

a tube configured in a tubular shape to define a tubular space and having a first end, a second end, an inner and outer diameter, and an inner surface, the inner surface of the tube including a phosphor layer;

a ring configured in a tubular shape having an inner and outer diameter substantially equal to the inner and outer diameter of the tube, respectively, the ring including a first damping material and a second damping material and a coolest portion located between the first damping material and the second damping material, and the first damping material connected about a periphery of the first end of the tube;

a first stem and a second stem each including a tubular shaped exhaust pipe, a closed end, a gateway, and an emitter electrode, the first stem being located at the first end of the tube and opposite to the second stem located at the second end of the tube, and the first stem located adjacent the second damping material of the ring, the exhaust pipe of the first stem extending to an area outside of the tube and defining a tubular space, the tubular space of the exhaust pipe of the first stem connected to the tubular space of the tube via a respective gateway, and the emitter electrode of the first stem facing the emitter electrode of the second stem within the tube; and a filler gas including a mercury vapor located in the tube and sealed in an air proof state, wherein the coolest portion includes a first material that has a higher thermal conductivity than with a thermal conductivity of the tube and a thermal conductivity of the first stem, and the first damping material and the second damping material are configured with both the first material and a second material that has a lower thermal conductivity than the thermal conductivity of the first material, and the first damping material and the second damping material are located between the tube and the first stem, the content ratio of the first material to the second material in the first damping material changes along a direction between an end of the first damping material located adjacent the coolest portion and an opposite end of the first damping material located adjacent the tube so as to be relatively higher at the end of the first damping material located adjacent the coolest portion and so as to be relatively lower at the opposite end of the first damping material, and the content ratio of the first material to the second material in the second damping material changes along a direction between an end of the second damping material located adjacent the coolest portion and an opposite end of the second damping material located adjacent the first stem so as to be relatively higher at the end of the second damping material located adjacent the coolest portion and so as to be relatively lower at the opposite end of the second damping material located adjacent the first stem.

15. The fluorescent lamp according to claim 14, wherein the coolest portion is located outside of vertical circular lines on at least one of the tube and the ring and surrounding the emitter electrode of the first stem.

16. The fluorescent lamp according to claim 14, wherein the first material is a metallic material and the second material is a glass.

17. A lighting unit comprising:

an outer casing including outer electrodes configured to receive power from a power supply;

a tube configured in a tubular shape having a first end, a second end, and an inner surface including a phosphor layer, the tube defining a tubular space;

a first stem and a second stem each including a tubular shaped exhaust pipe, a gateway, lead wires, and an emitter electrode attached to the lead wires, the first stem located at the first end of the tube and opposite to the second stem located at the second end of the tube, and each exhaust pipe extending to an area outside of the tube and defining a tubular space, and the tubular space of each of the exhaust pipes is connected to the tubular space of the tube via each respective gateway, and each of the lead wires extend outside of the tube and are electrically connected to respective ones of the outer electrodes of the outer casing;

a damping material connected to an open end of the exhaust pipe of the first stem, the damping material configured in a tubular shape and having an open end;

a coolest portion configured in a tubular shape having a closed end and an open end, the open end connected to the open end of the damping material;

a filler gas including a mercury vapor located in the tube and sealed in an air proof state, wherein the coolest portion includes a first material that has a higher thermal conductivity than both a thermal conductivity of the tube and a thermal conductivity of the first stem, and the coolest portion contacts a part of high thermal conductivity located in the outer casing, the damping material includes both the first material and a second material that has a lower thermal conductivity than the thermal conductivity of the first material, and the damping material is connected to the first stem, a content ratio of the first material to the second material in the damping material is configured to change along a direction between the open end of the damping material connected to the coolest portion and an opposite end connected to the exhaust pipe of the first stem such that the content ratio is relatively higher towards the open end of the damping material located adjacent the coolest portion and the content ratio is relatively lower towards the opposite end of the damping material located adjacent the exhaust pipe, and the outer casing covers at least the tube and the first and second stems.

18. The light unit according to claim 17, wherein the damping material is integrated into the coolest portion as one body.

19. The light unit according to claim 17, wherein the first material is a metallic material and the second material is a glass.

20. The light unit according to claim 18, wherein the first material is a metallic material and the second material is a glass.

* * * * *